US011325743B2

(12) United States Patent
Simpkins et al.

(10) Patent No.: US 11,325,743 B2
(45) Date of Patent: May 10, 2022

(54) RETAIL READY HARNESS STYLE WRAP AROUND SPLIT CASE

(71) Applicants: WestRock Shared Services, LLC, Atlanta, GA (US); Bellisio Foods, Inc., Minneapolis, MN (US)

(72) Inventors: Kevin M. Simpkins, Cumming, GA (US); Matthew Woodard Lorence, Plymouth, MN (US)

(73) Assignees: Westrock Shared Services, LLC, Atlanta, GA (US); Bellisio Foods, Inc., Minneapolis, MN (US)

( * ) Notice: Subject to any disclaimer, the term of this patent is extended or adjusted under 35 U.S.C. 154(b) by 0 days.

(21) Appl. No.: 16/830,189

(22) Filed: Mar. 25, 2020

(65) Prior Publication Data

US 2020/0307853 A1 Oct. 1, 2020

Related U.S. Application Data

(63) Continuation-in-part of application No. 16/369,785, filed on Mar. 29, 2019.

(51) Int. Cl.

| | |
|---|---|
| ***B65D 5/54*** | (2006.01) |
| ***B65D 5/42*** | (2006.01) |
| ***B65D 5/02*** | (2006.01) |

(52) U.S. Cl.

CPC ..... *B65D 5/5445* (2013.01); *B65D 5/0227* (2013.01); *B65D 5/4266* (2013.01)

(58) Field of Classification Search

CPC ..... B65D 5/0227; B65D 5/02; B65D 5/4266; B65D 5/54; B65D 77/042; B65D 5/5445; B65D 5/4608; B65D 5/5405; B65D 5/545

USPC ..... 206/774, 736; 229/237

See application file for complete search history.

(56) References Cited

U.S. PATENT DOCUMENTS

| | | | | |
|---|---|---|---|---|
| 4,058,206 | A | 11/1977 | Morse et al. | |
| 5,857,570 | A | 1/1999 | Brown | |
| 5,910,856 | A * | 6/1999 | Ghosh | G02B 26/085 359/291 |
| 5,921,398 | A * | 7/1999 | Carroll | B65D 5/54 206/736 |
| 5,927,498 | A * | 7/1999 | Saam | B65D 5/52 206/499 |
| 6,073,833 | A | 6/2000 | Desrosiers et al. | |

(Continued)

FOREIGN PATENT DOCUMENTS

| | | | |
|---|---|---|---|
| JP | H06-069122 | U | 9/1994 |
| JP | 2002274530 | A | 9/2002 |

(Continued)

OTHER PUBLICATIONS

PCT International Search Report and Written Opinion dated Jul. 21, 2020, issued during the prosecution of PCT International Application No. PCT/US2020/025782.

(Continued)

*Primary Examiner* — Chun Hoi Cheung

(74) *Attorney, Agent, or Firm* — Locke Lord LLP; Alicia J. Carroll; Gabrielle L. Gelozin

(57) ABSTRACT

A retail ready package configured for division into two separate product display cases is disclosed wherein two rows of products are arranged side-by-side within the package in a vertical front facing display orientation relative to the left and right lower front panels of the package.

20 Claims, 10 Drawing Sheets

(56) References Cited

U.S. PATENT DOCUMENTS

| | | | | |
|---|---|---|---|---|
| 6,129,211 | A | 10/2000 | Prakken et al. | |
| 6,435,351 | B1 * | 8/2002 | Gibb | B65D 5/542 206/736 |
| 6,523,692 | B2 | 2/2003 | Gregory | |
| 7,021,468 | B2 * | 4/2006 | Cargile, Jr. | B65B 5/061 206/746 |
| 7,225,930 | B2 * | 6/2007 | Ford | B65D 5/5445 206/746 |
| 8,028,839 | B2 * | 10/2011 | Learn | B65D 5/504 206/774 |
| 8,740,054 | B2 | 6/2014 | Pinkstone | |
| 9,187,207 | B2 * | 11/2015 | Gessler, Jr. | B65D 5/54 |
| 9,809,349 | B2 | 11/2017 | Gessler, Jr. et al. | |
| 9,938,040 | B2 * | 4/2018 | Buscema | B31B 50/812 |
| 2005/0184139 | A1 | 8/2005 | Gasior | |
| 2006/0006096 | A1 | 1/2006 | Funk | |
| 2006/0266815 | A1 * | 11/2006 | Coltri-Johnson | B65D 5/445 229/242 |
| 2009/0302098 | A1 | 12/2009 | Learn | |
| 2014/0216981 | A1 | 8/2014 | Kuhn | |
| 2018/0065774 | A1 | 3/2018 | Gessler, Jr. et al. | |
| 2018/0305069 | A1 * | 10/2018 | Keefe, Jr. | B65D 5/5445 |
| 2019/0023449 | A1 | 1/2019 | Barton et al. | |
| 2019/0322412 | A1 | 10/2019 | Couture et al. | |
| 2020/0017256 | A1 | 1/2020 | Hermosillo | |
| 2020/0223581 | A1 * | 7/2020 | Lohoff | B65D 5/542 |

FOREIGN PATENT DOCUMENTS

| | | | |
|---|---|---|---|
| JP | 2013224171 | A | 10/2013 |
| KR | 20090000139 | U | 1/2009 |
| KR | 20130004164 | U | 7/2013 |

OTHER PUBLICATIONS

PCT International Search Report and Written Opinion dated Jul. 24, 2020, issued during the prosecution of PCT International Patent Application No. PCT/US2020/025741.

* cited by examiner

RETAIL READY HARNESS STYLE WRAP AROUND SPLIT CASE

CROSS-REFERENCE TO RELATED APPLICATIONS

This application is a continuation-in-part of U.S. patent application Ser. No. 16/369,785 filed on Mar. 29, 2019, the contents of which are incorporated by reference herein in their entirety.

BACKGROUND OF THE INVENTION

1. Field of the Invention

The subject invention is directed to product packaging, and more particularly, to a retail ready harness style wrap around case configured to be split in half for displaying products in two separate display cases.

2. Description of Related Art

Retailers, such as big-box stores, superstores and warehouse clubs sell large quantities of fast moving consumer goods. These retailers often want to have items shipped from their distribution centers to stores in unit loads and bulk boxes that can be stocked without handling of the merchandise.

The goal for corrugated shipping containers is to put case goods directly onto shelves and stocking locations without individually handling the unit packs or primary packages. To this end, retailers often require products to come in shelf ready packaging to reduce stocking costs and save labor expenses. Shelf ready packaging, also known as, retail ready packaging refers to the packaging of a product so that it is delivered to a retailer in a manner optimized for efficient stocking and sale.

Some retailers prefer to ship carded products, such as blister packs and frozen foods, in two separate rows arranged in a side-by-side orientation. However, this orientation presents problems when displaying the products on a shelf so that they are aesthetically pleasing and readily accessible to a customer. Thus, it would be beneficial to provide a retail ready package that is adapted and configured for displaying two separate rows of products that are arranged side-by-side in a vertical front facing display orientation for ready access by a consumer. The subject invention provides for such a package.

SUMMARY OF THE DISCLOSURE

The subject invention is directed to a retail ready package configured for division into two separate product display cases wherein two rows of products are arranged side-by-side within the package in a vertical front facing display orientation relative to the left and right lower front panels of the package.

More particularly, the subject invention is directed to a blank for constructing a retail ready package configured for division into two separate product display cases, which includes left and right lower front panels, left and right bottom panels respectively foldably connected to the left and right lower front panels along a lower front horizontal fold line and separated from one another along a bottom vertical perforation line, and left and right lower rear panels respectively foldably connected to the left and right bottom panels along a lower rear horizontal fold line and separated from one another along a lower rear vertical perforation line. The left and right lower rear panels have respective left and right lower rear side flaps foldably connected thereto.

The blank further includes an upper rear panel separably connected to the left and right lower rear panels along a shaped upper rear cut line, a top panel foldably connected to the upper rear panel along an upper rear horizontal fold line, and an upper front panel foldably connected to the top panel along an upper front horizontal fold line. The upper rear panel has left and right upper rear side flaps foldably connected thereto. The left and right upper rear side flaps are separated from the left and right lower rear side flaps by respective continuations of the shaped upper rear cut line associated with the upper rear panel. The shaped upper rear cut line and at least one of the respective continuations of the shaped upper rear cut line together form a shaped line of weakeness having a first cut section, a second cut section and a perforated section between the first and second cut sections.

The upper front panel can have left and right upper front side flaps foldably connected thereto. The bottom panel can have left and right bottom side flaps foldably connected thereto. A portion of a surface of the left upper front side flap and a portion of a surface of the left bottom side flap that face one another can be free from glue to facilitate removal of the removable portion from the display portion. A portion of a surface of the right upper front side flap and a portion of a surface of the right bottom side flap that face one another can be free from glue to facilitate removal of the removable portion from the display portion.

In accordance with a preferred embodiment of the subject invention, the upper rear panel, the top panel and the upper front panel are adapted and configured to be separated from the left and right lower front panels, the left and right bottom panels and the left and right lower rear panels along the shaped upper rear cut line associated with the upper rear panel. Furthermore, the left lower front panel, the left bottom panel and the left lower rear panel are adapted and configured to be divided from the right lower front panel, the right bottom panel and the right lower rear panel along the bottom vertical perforation line and the lower rear vertical perforation line to form two separate product display cases.

The first cut section can include a first linear cut segment having a length of ¾ of an inch, and a second linear cut segment having a length of one inch. The second linear cut segment can be at an angle relative to the first linear cut segment. The perforated section can extend linearly from the first cut section and has a length of 3 inches. The perforated section can include perforation holes that are 0.075 inches apart, and there are eight perforation holes per inch of perforated section.

The second cut section can include a first linear cut segment having a length of 2.75 inches, a second linear cut segment extending from the first linear cut segment having a length of one inch, an arcuate cut segment tangentially extending from the second linear cut segment, and a third linear cut segment extending from the arcuate cut segment having a length of 15/16 of an inch. The second linear cut segment can be angled relative to the first linear cut segment, wherein the arcuate cut segment has a radius of 0.709 inches. The arcuate cut segment can extend between and is tangential to the second and third linear cut segments. The third linear cut segment can be angled relative to the second linear cut segment. The second linear cut segment of the second cut section extends across a fold line between the upper rear panel and the upper rear side flap.

The shaped line of weakness can include a second perforated section and a third cut section. The second perforated section can extend between the second and third cut sections on the upper rear side flap. The second perforated section can extend linearly from the second cut section. The perforated section can have a length of 3 and 5/16 inches. The third cut section can include a first linear cut segment having a length of 1 and 21/32 inches, an arcuate cut segment tangentially extending from the first linear cut segment, and a second linear cut segment having a length of 5/16 of an inch. The second linear cut segment can be angled relative to the first linear cut segment. The arcuate cut segment can have a radius of 0.709 inches. The arcuate cut segment can extend between and is tangential to the first and second linear cut segments. The blank can be formed from a die cut corrugated cardboard sheet. The left and right lower front panels can be separated from one another by a shaped front notch.

The left and right lower front panels have respective left and right lower front side flaps foldably connected thereto, the left and right bottom panels have respective left and right bottom side flaps foldably connected thereto, the left and right lower rear panels have respective left and right lower rear side flaps foldably connected thereto, and the upper rear panel has left and right upper rear side flaps foldably connected thereto.

In addition, the top panel has left and right top side flaps foldably connected thereto and the upper front panel has left and right upper front side flaps foldably connected thereto. Preferably, the upper front panel has a front recessed access area formed in an upper edge thereof, wherein the recessed area aligns with the shaped front notch separating the left and right lower front panels.

These and other features of the retail ready package of the subject invention will become more readily apparent to those having ordinary skill in the art to which the subject invention appertains from the detailed description of the preferred embodiments taken in conjunction with the following brief description of the drawings.

BRIEF DESCRIPTION OF THE DRAWINGS

So that those skilled in the art will readily understand how to make and use the retail ready package of the subject invention without undue experimentation, preferred embodiments thereof will be described in detail herein below with reference to the figures wherein.

DETAILED DESCRIPTION OF THE PREFERRED EMBODIMENTS

Figure 1:
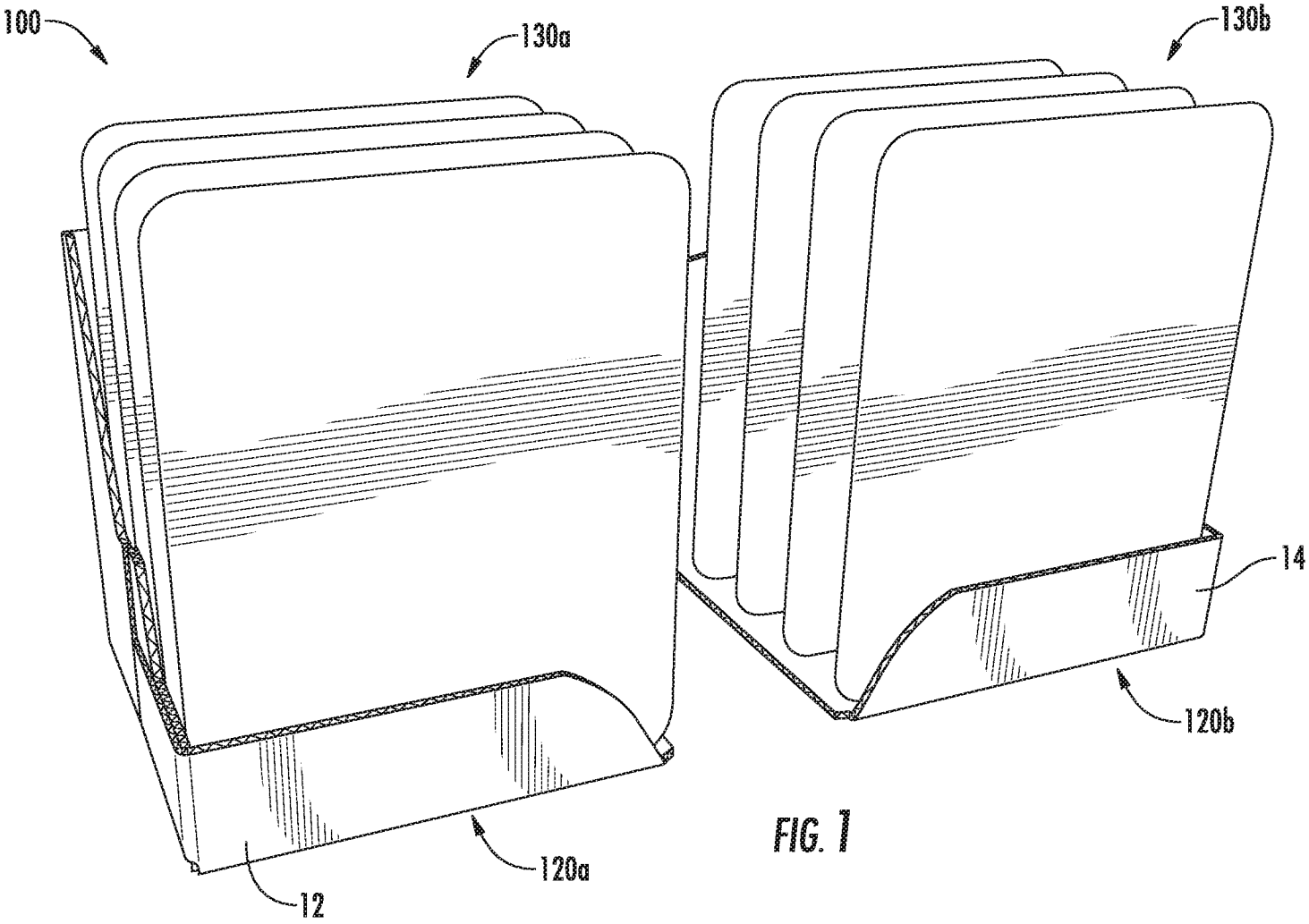
FIG. 1 is a perspective view of the display configuration of the retail ready package of the subject invention, which is split into two separate product display cases.

Referring now to the drawings wherein like reference numerals identify similar structural features or elements of the subject invention, there is illustrated in FIG. 1 a retail ready package 100 for shipping and displaying products, and more particularly, a harness wrap style retail ready package configured for division into two separate product display cases 120*a* and 120*b*, wherein two rows of products 130*a* and 130*b* are arranged side-by-side within the package in a vertical front facing display orientation relative to the left and right lower front panels 12 and 14 of the package, as best seen in FIG. 1.

Figure 2:
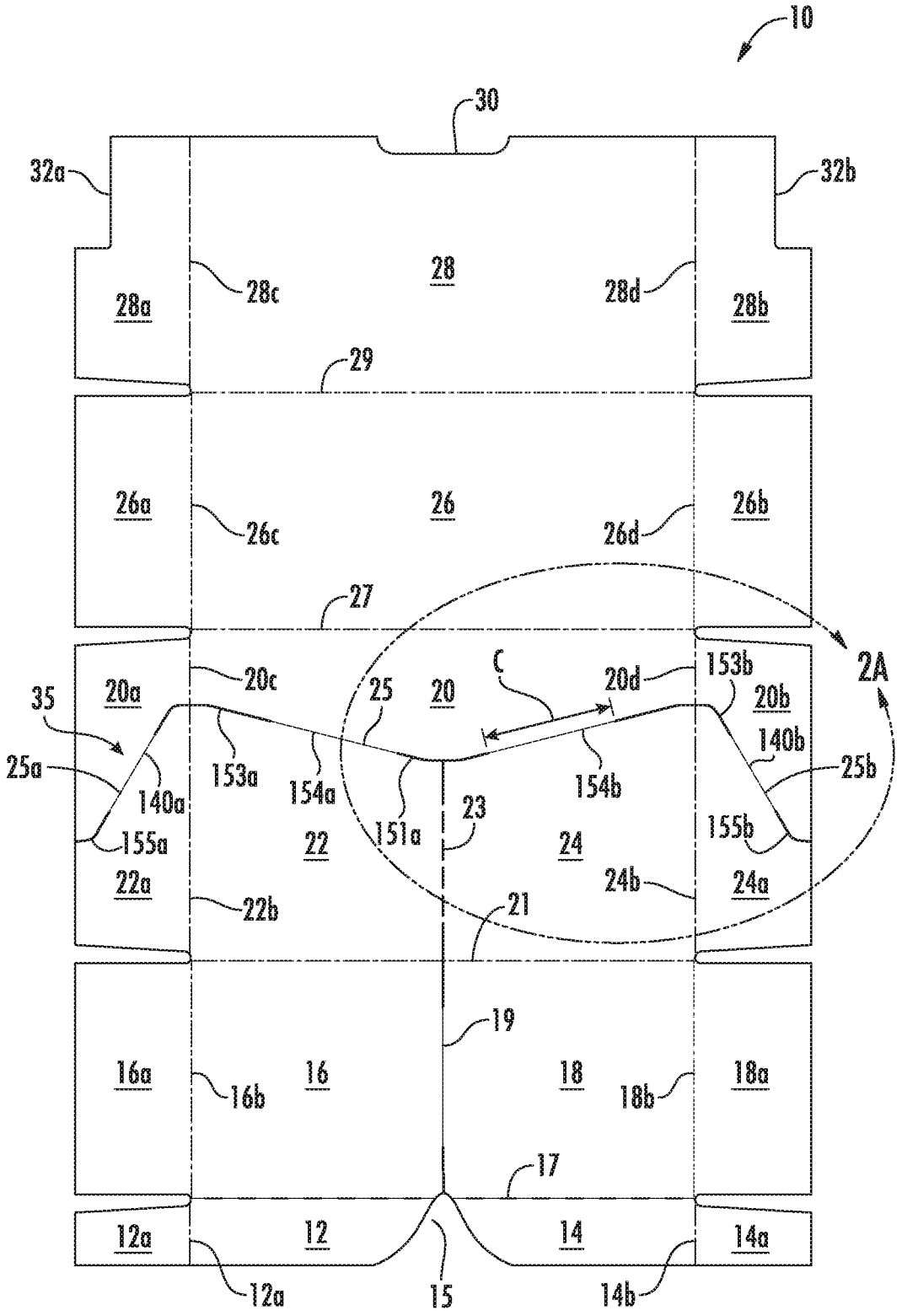
FIG. 2 is a top plan view of a blank for forming the retail ready package of the subject invention, which includes a removable portion and a display portion.

Referring to FIG. 2, there is illustrated a blank for forming the retail ready package of the subject invention, which his designated generally by reference numeral 10. The blank 10 is preferably formed from a die cut corrugated cardboard sheet or a similar material. In the description that follows, the panels of the blank 10 are described relative to the display orientation of a fully constructed package, as opposed to the shipping orientation of the package. Moreover, as explained in more detail below, in the shipping orientation, which is shown for example in FIG. 5, the front of the package faces upward, rather than forward, as it would on a shelf, as previously shown in FIG. 1.

The blank 10 includes left and right lower front panels 12 and 14 separated from one another by a shaped front notch 15. The left and right lower front panels 12 and 14 have respective left and right lower front side flaps 12*a* and 14*a* that are foldably connected thereto along respective fold line 12*b* and 14*b*. Left and right bottom panels 16 and 18 are respectively foldably connected to the left and right lower front panels 12 and 14 along a lower front horizontal fold line 17 and they are separated from one another along a bottom vertical perforation line 19. The left and right bottom panels 16 and 18 have respective left and right bottom side flaps 16*a* and 18*a* foldably connected thereto along respective vertical fold lines 16*b* and 18*b*.

The blank 10 further includes left and right lower rear panels 22 and 24 respectively foldably connected to the left and right bottom panels 16 and 18 along a lower rear horizontal fold line 21 and they are separated from one another along a lower rear vertical perforation line 23. The left and right lower rear panels 22 and 24 have respective left and right lower rear side flaps 22*a* and 24*a* foldably connected thereto along respective vertical fold lines 22*b* and 24*b*.

An upper rear panel 20 is separably connected to the left and right lower rear panels 22 and 24 along a shaped upper rear cut line 25. The upper rear panel 20 has left and right upper rear side flaps 20*a* and 20*b* foldably connected thereto along respective fold lines 20*c* and 20*d*. The left and right upper rear side flaps 20*a* and 20*b* are separated from the left and right lower rear side flaps 22*a* and 24*a* by respective left and right continuations 25*a* and 25*b* of the shaped upper rear cut line 25 associated with the upper rear panel 20.

Figure 2A:
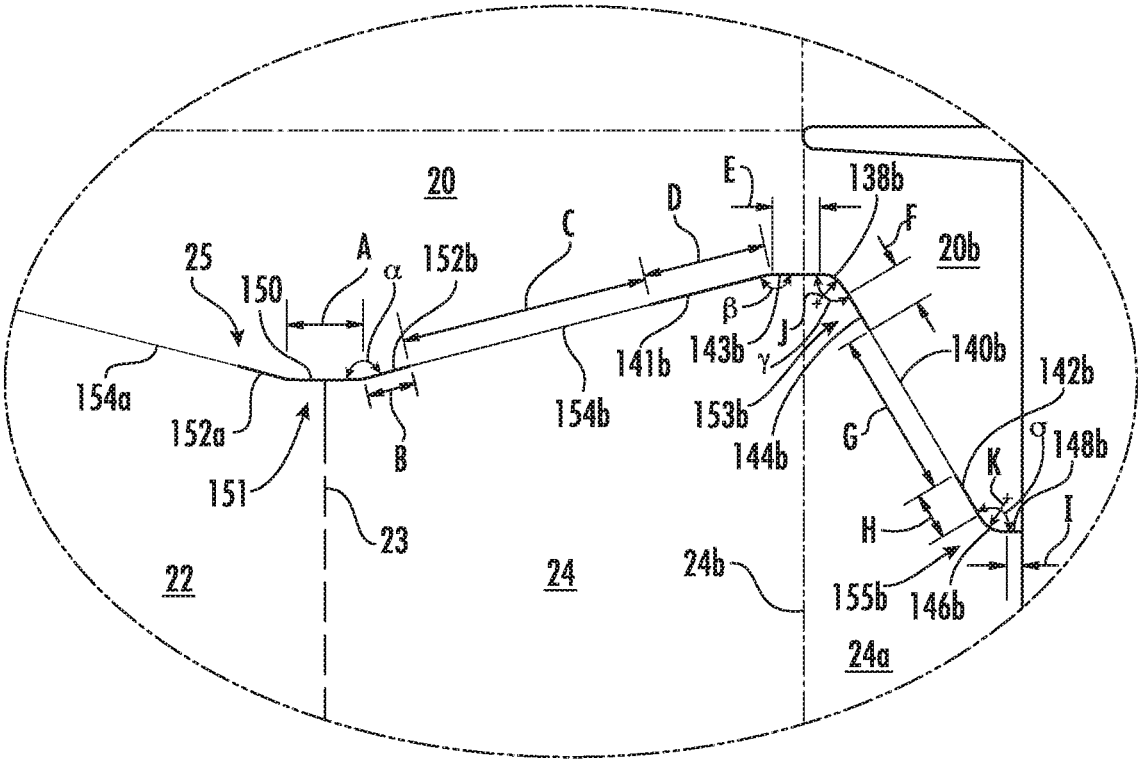
FIG. 2A is an enlarged portion of the blank of FIG. 2, showing the shaped upper rear cut line and the continuation thereof that separates the right upper rear side flap and the right lower rear side flap.

As shown in FIGS. 2 and 2A, the shaped upper rear cut line 25 and respective left and right continuations 25*a* and 25*b* together form a shaped line of weakeness 35 having a first cut section 151, second cut sections 153*a* and 153*b*, perforated sections 154*a* and 154*b*, second perforated sections 140*a* and 140*b*, and third cut sections 155*a* and 155*b*. The shaped line of weakness 35 is symmetrical about vertical perforation line 23. As shown in FIG. 2, the cut sections are shown in a bolded line. The arrangement and dimensions of the shaped line of weakness 35, as will be described in more detail below, help to propagate tearing of perforated sections 154*a* and 154*b* and second perforated sections 140*a* and 140*b*.

With continued reference to FIGS. 2 and 2A, the first cut section 151 includes a first linear cut segment 150 having a length A of ¾ of an inch. First linear cut segment 150 extends between left and right lower rear panels 22 and 24 such that it is perpendicular to and bisected by vertical perforation line 23. As the shaped line of weakness 35 is symmetrical about first linear cut segment 150 and vertical perforation line 23, only one side of cut segments and perforated sections (e.g. the right hand side as oriented in FIG. 2) will be described herein. The first cut section 151 includes a second linear cut segment 152*b* having a length B of one inch. The second linear cut segment 152*b* is obliquely angled relative to the first linear cut segment 150 at an angle α of about 165.8° and extends from the right-hand side of the first linear cut segment 150, as oriented in FIGS. 2 and 2A. The second linear cut segment 152*a* on the left side is substantially symmetrical to second linear cut segment 152*b* and is dimensionally substantially similar thereto.

As shown in FIGS. 2 and 2A, the perforated section 154*b* extends linearly from the right-hand side (as oriented in FIGS. 2 and 2A) of the first cut section 151, is parallel to second linear cut segment 152*b*, and has a length C of 3 inches. Perforated section 154*b* extends to a first linear cut segment 141*b* of the second cut section 153*b* and is parallel thereto. Perforated section 154*a* is substantially symmetrical to perforated section 154*b*. The perforated sections 154*a* and 154*b* (and perforated sections 140*a* and 140*b*, described below) include perforation holes that are 0.075 inches apart, and there are eight perforation holes per inch of perforated section. For example, perforated section 154*a* and/or 154*b* can be formed using a PERFormaX 860 steel rule (available from National Steel Rule, Linden, N.J.), or the like, which has eight teeth per inch of rule, each tooth is 0.05 inches wide and there are 0.075 inches between each tooth.

With reference now to FIGS. 2 and 2A, second cut section 153*b* extends from perforated section 154*b* and includes a first linear cut segment 141*b* having a length D of 2.75 inches, a second linear cut segment 143*b* extending from the first linear cut segment 141*b* having a length E of one inch, an arcuate cut segment 138*b* tangentially extending from the second linear cut segment 143*b*, and a third linear cut segment 144*b* extending from the arcuate cut segment 138*b* having a length F of 15/16 of an inch. The second linear cut segment 143*b* is obliquely angled relative to the first linear cut segment 141*b* at an angle β of about 165.8°. The arcuate cut segment 138*b* has a radius J of 0.709 inches. The arcuate cut segment 138*b* extends between and is tangential to the second and third linear cut segments 143*b* and 144*b*. The third linear cut segment 144*b* is obliquely angled relative to the second linear cut segment 143*a* at an angle γ of about 120.6°. The second linear cut segment 143*b* of the second cut section 153*b* extends across fold lines 24*b* and 20*d* between the upper rear panel 20 and the right upper rear side flap 20*b*. The second cut section 153*a* is substantially symmetrical to second cut section 153*b* and includes similar linear and arcuate cut sections.

As shown in FIG. 2A, the second perforated section 140*b* extends between the second and third cut sections 153*b* and 155*b* and divides right upper rear side flap 20*b* and right lower rear side flap 24*a*. The second perforated section 140*b* extends linearly from the third linear cut segment 144*b* of second cut section 153*b*, and is parallel to third linear cut segment 144*b*. Perforated section 140*b* extends to a first linear cut segment 142*b* of the third cut section 155*b* and is parallel thereto. The perforated section 140*b* has a length G of 3 and 5/16 inches. Second perforated section 140*b* is substantially symmetrical to perforated section 140*a* and has a perforation spacing and pattern similar to perforated section 154*b*, as described above. The third cut section 155*b* includes a first linear cut segment 142*b* having a length H of 1 and 21/32 inches, an arcuate cut segment 146*b* tangentially extending from the first linear cut segment 142*b*, and a second linear cut segment 148*b* having a length I of 5/16 of an inch. The second linear cut segment 148*b* is obliquely angled relative to the first linear cut segment 142*b* at an angle σ of about 120.6°. The arcuate cut segment 146*b* has a radius K of 0.709 inches. The arcuate cut segment 146*b* extends between and is tangential to the first and second linear cut segments 142*b* and 148*b*. The third cut section 155*a* is substantially symmetrical to third cut section 155*b* and includes similar linear and arcuate cut sections.

The blank 10 is formed from a die cut corrugated cardboard sheet having a variable thickness and weight depending on design needs. The complete cut-throughs that form first, second and third cut sections 151, 153*a* and 153*b*, and 155*a* and 155*b* (on both the left and right hand sides) in combination with the perforated sections 154*a*, 154*b*, 140*a*, and 140*b*, provide the appropriate break-away force for the board thickness such that a user is able to tear the perforation and separate the portion 110 of the package 100 from the display portion 120 of the package 100, while still providing sufficient strength to prevent unwanted tearing.

The blank 10 also includes a top panel 26 that is foldably connected to the upper rear panel 20 along an upper rear horizontal fold line 27, and an upper front panel 28 foldably connected to the top panel 26 along an upper front horizontal fold line 29. The top panel 26 has left and right top side flaps 26*a* and 26*b* foldably connected thereto along respective fold lines 26*c* and 26*d*, and the upper front panel 28 has left and right upper front side flaps 28*a* and 28*b* foldably connected thereto along respective fold lines 28*c* and 28*d*. The left and right upper front side flaps 28*a* and 28*b* are formed with lateral cut-outs 32*a* and 32*b* that define hand hold areas for carrying the fully erected and loaded retail ready package 100 of the subject invention, as shown for example in FIG. 5.

Figure 5:
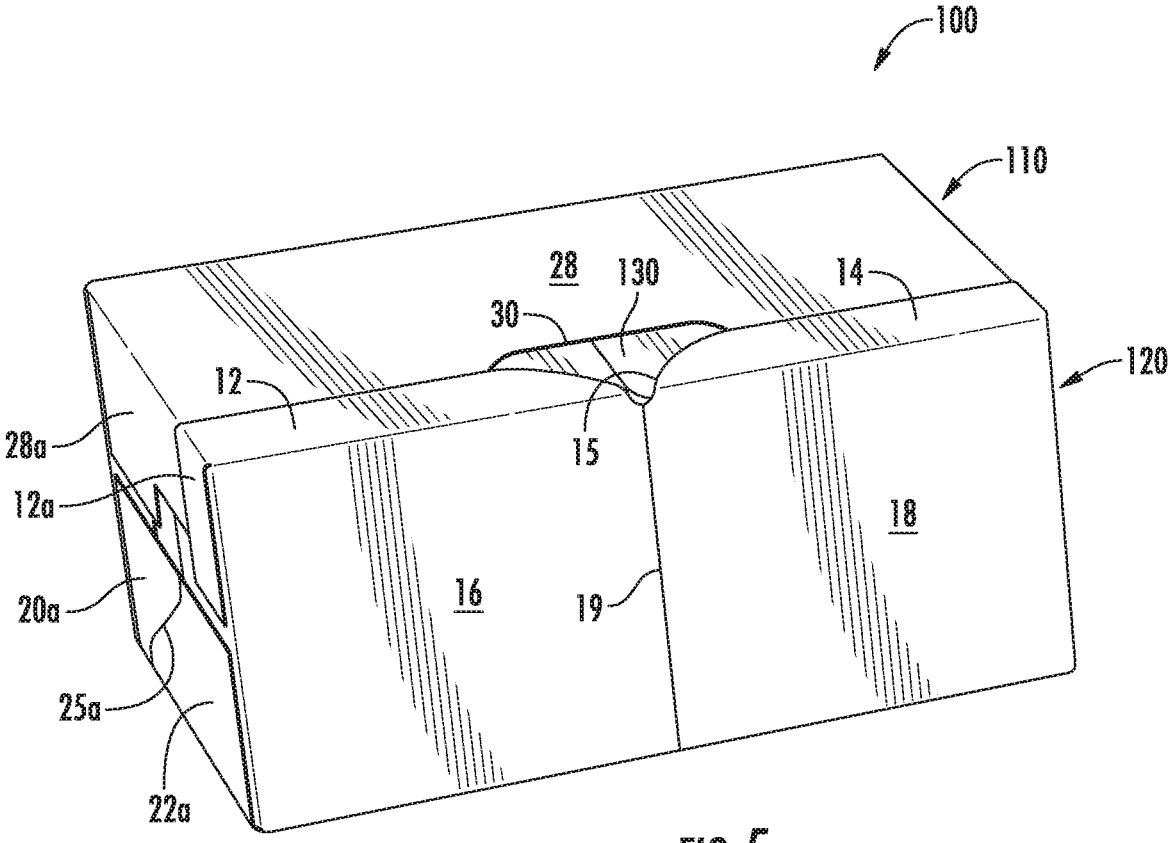
FIG. 5 is a perspective view of the retail ready package of the subject invention in a fully loaded shipping condition.

Preferably, the upper front panel 28 has a front recessed access area 30 formed in an upper edge thereof, wherein the recessed area 30 aligns with the shaped front notch 15 that separates the left and right lower front panels 12 and 14 from one another, as shown in FIG. 5. Together, the recessed area 30 and notch 15 form an opening where the removable portion 110 of the package 100 can be separated from the display portion 120 of the package 100.

Figure 6:
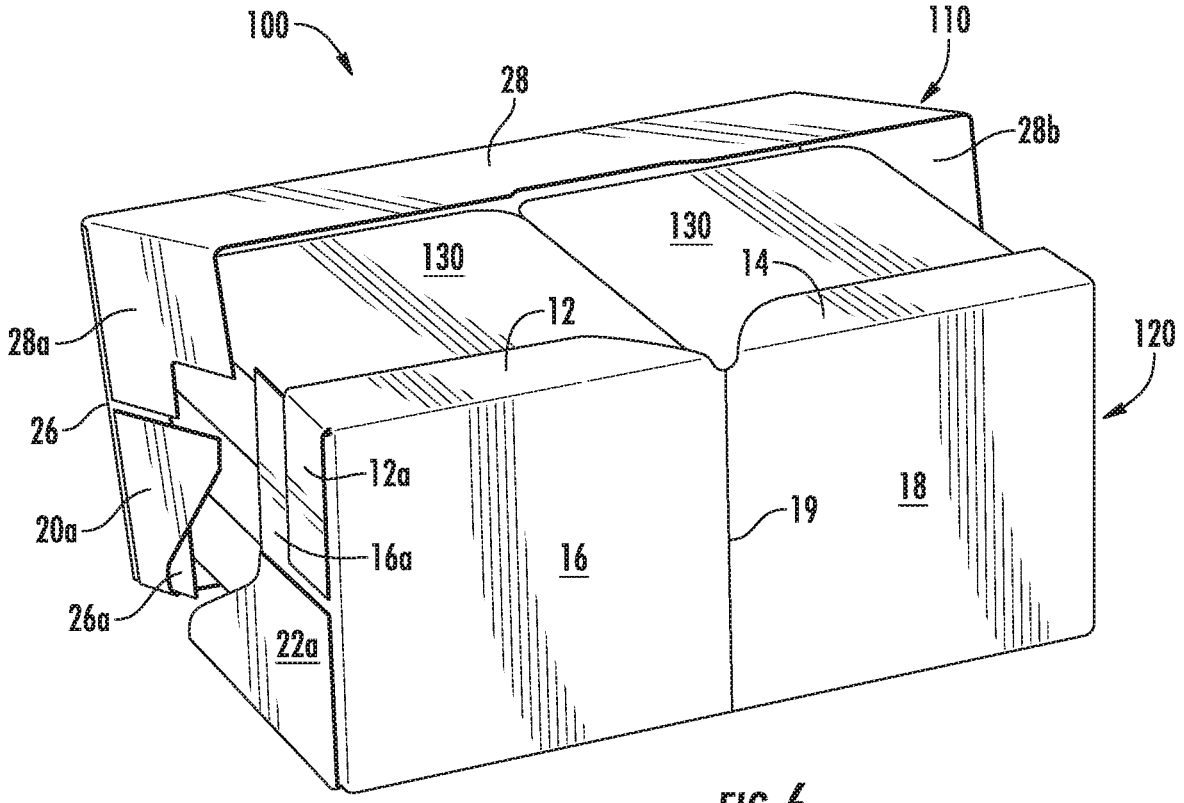
FIG. 6 is a perspective view of the retail ready package of the subject invention as the removable portion of the package is being separated from the display portion of the package, while the package is in its shipping orientation with products facing upward.
Figure 7:
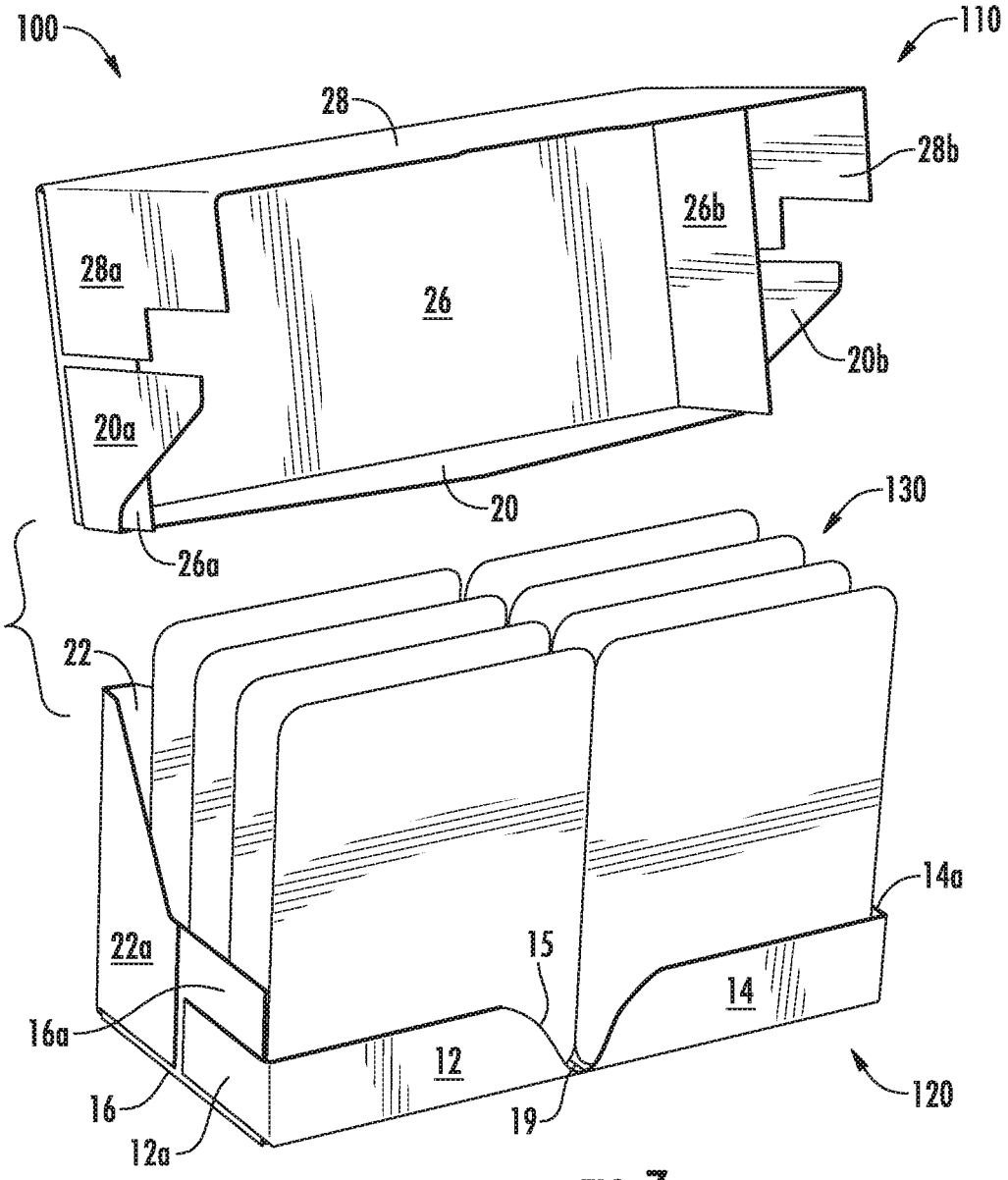
FIG. 7 is a perspective view of the retail ready package of the subject invention with the removable portion of the package completely separated from the display portion of the package, and wherein the package is in its display orientation with products facing forward.
Figure 8:
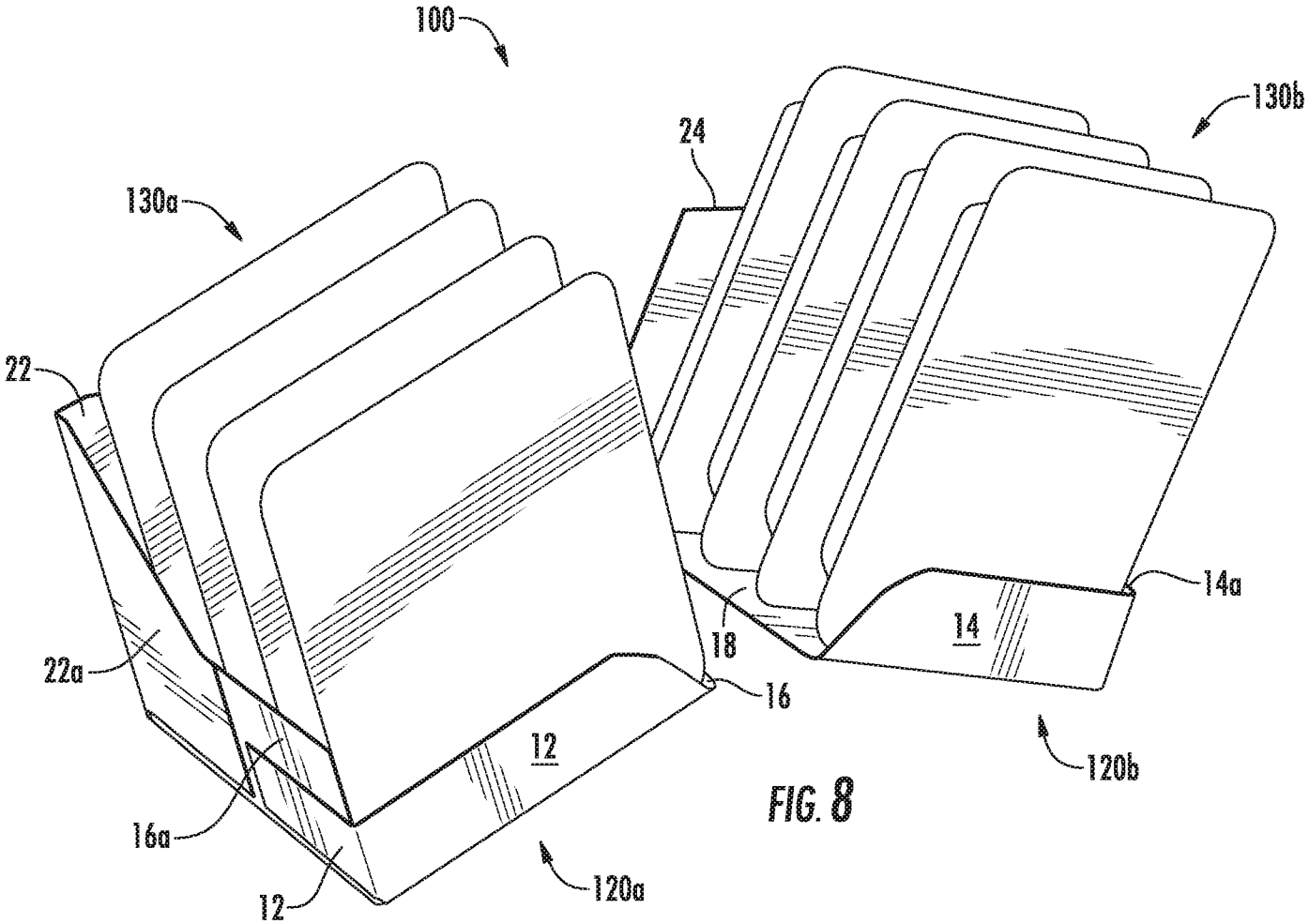
FIG. 8 is a perspective view of the display portion of the retail ready package of the subject invention as the display portion of the package is split into two separate display cases.
Figure 9:
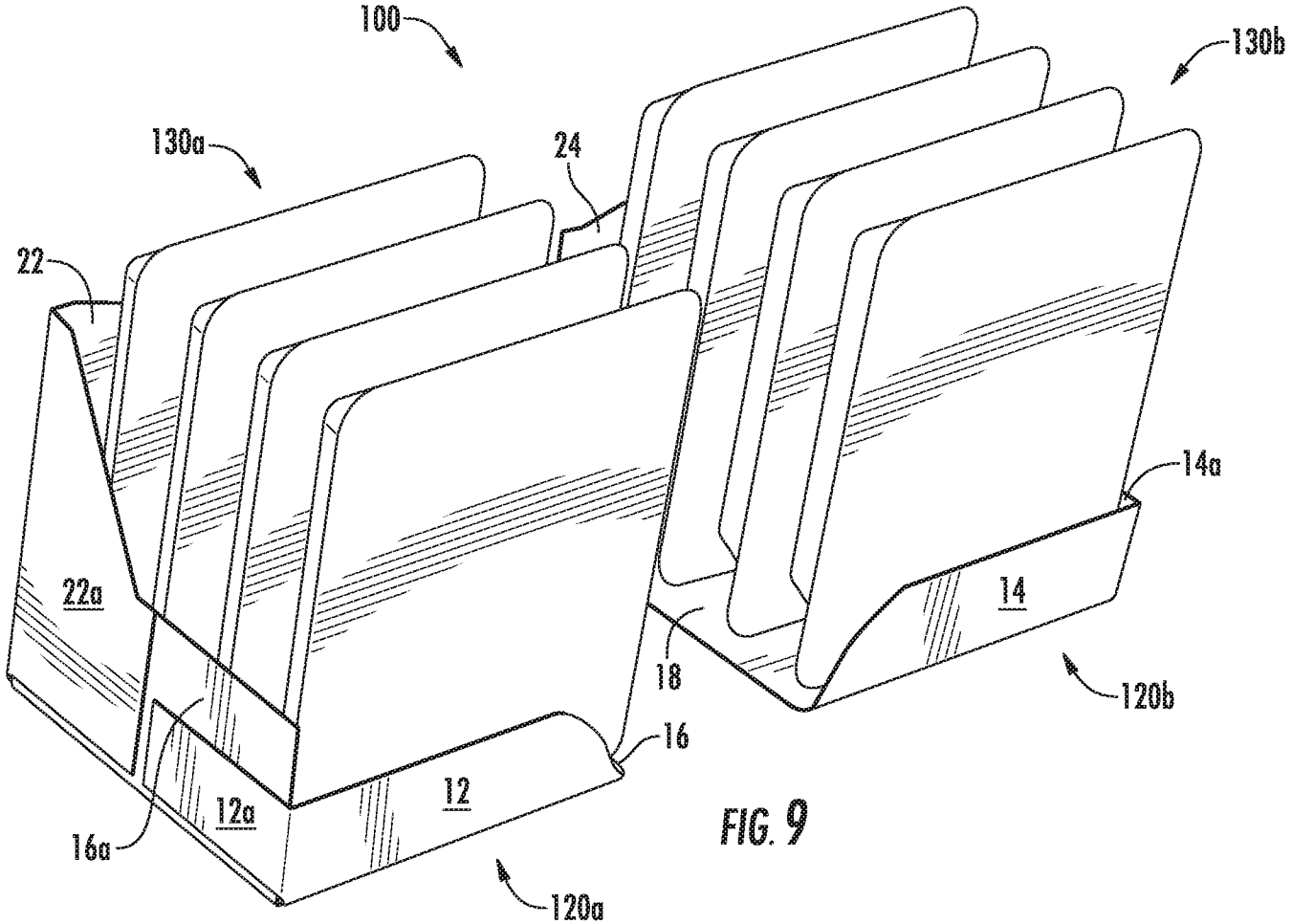
FIG. 9 is a perspective view of the display configuration of the retail ready package of the subject invention divided into two separate product display cases wherein two rows of products are arranged side-by-side in a vertical front facing display orientation.

More particularly, in accordance with a preferred embodiment of the subject invention, as best seen in FIGS. 6 and 7, the upper rear panel 20, the top panel 26 and the upper front panel 28 are adapted and configured to be separated from the left and right lower front panels 12 and 14, the left and right bottom panels 16 and 18, and the left and right lower rear panels 22 and 24 along the shaped upper rear cut line 25 associated with the upper rear panel 20. Furthermore, the left lower front panel 12, the left bottom panel 16 and the left lower rear panel 22 are adapted and configured to be divided from the right lower front panel 14, the right bottom panel 18 and the right lower rear panel 24 along the bottom vertical perforation line 19 and the lower rear vertical perforation line 23 to form two separate product display cases, as shown in FIGS. 8 and 9.

Figure 3:
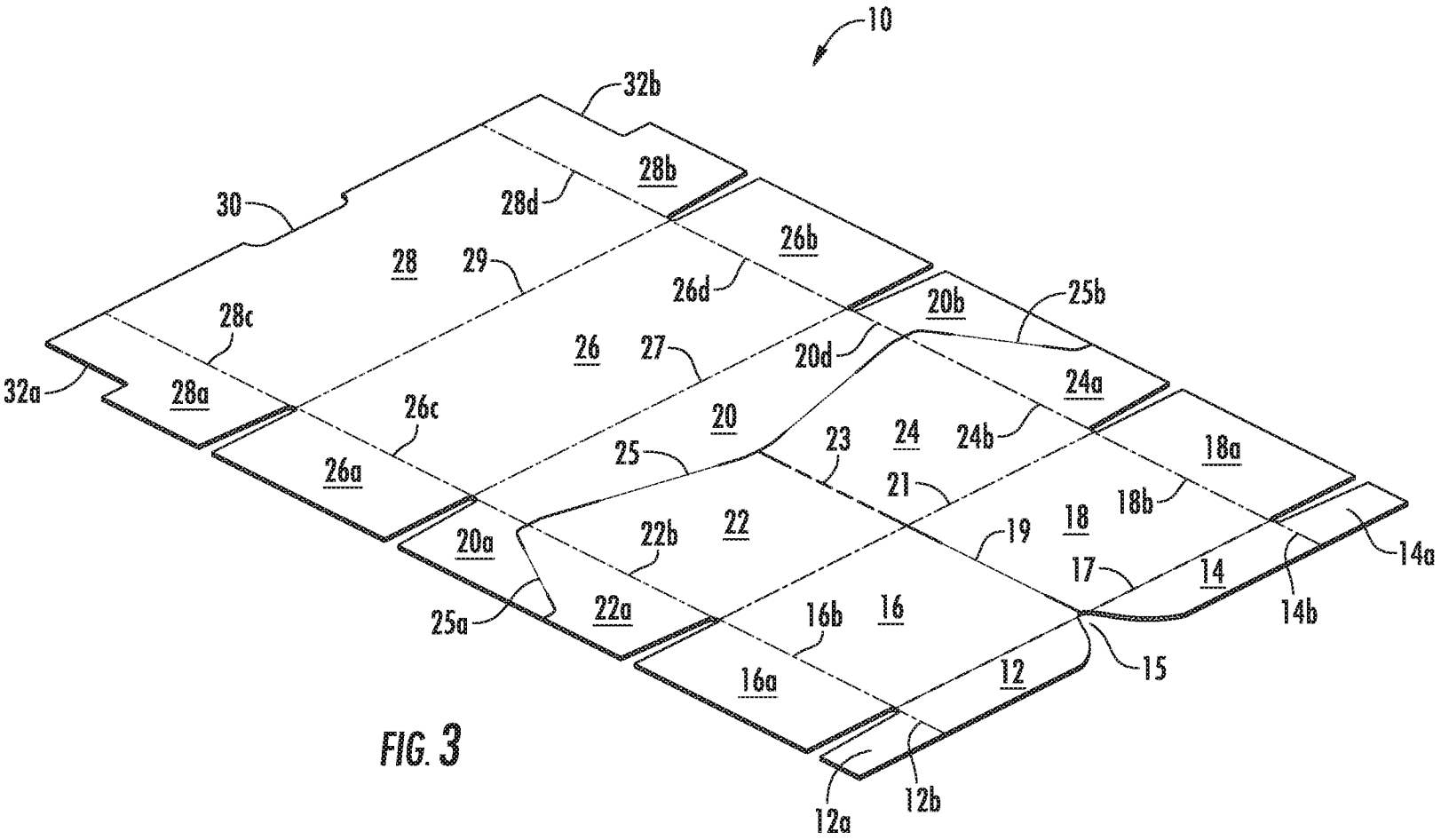
FIG. 3 is a perspective view of the blank for forming the retail ready package of the subject invention, which includes a removable portion and a display portion.
Figure 4:
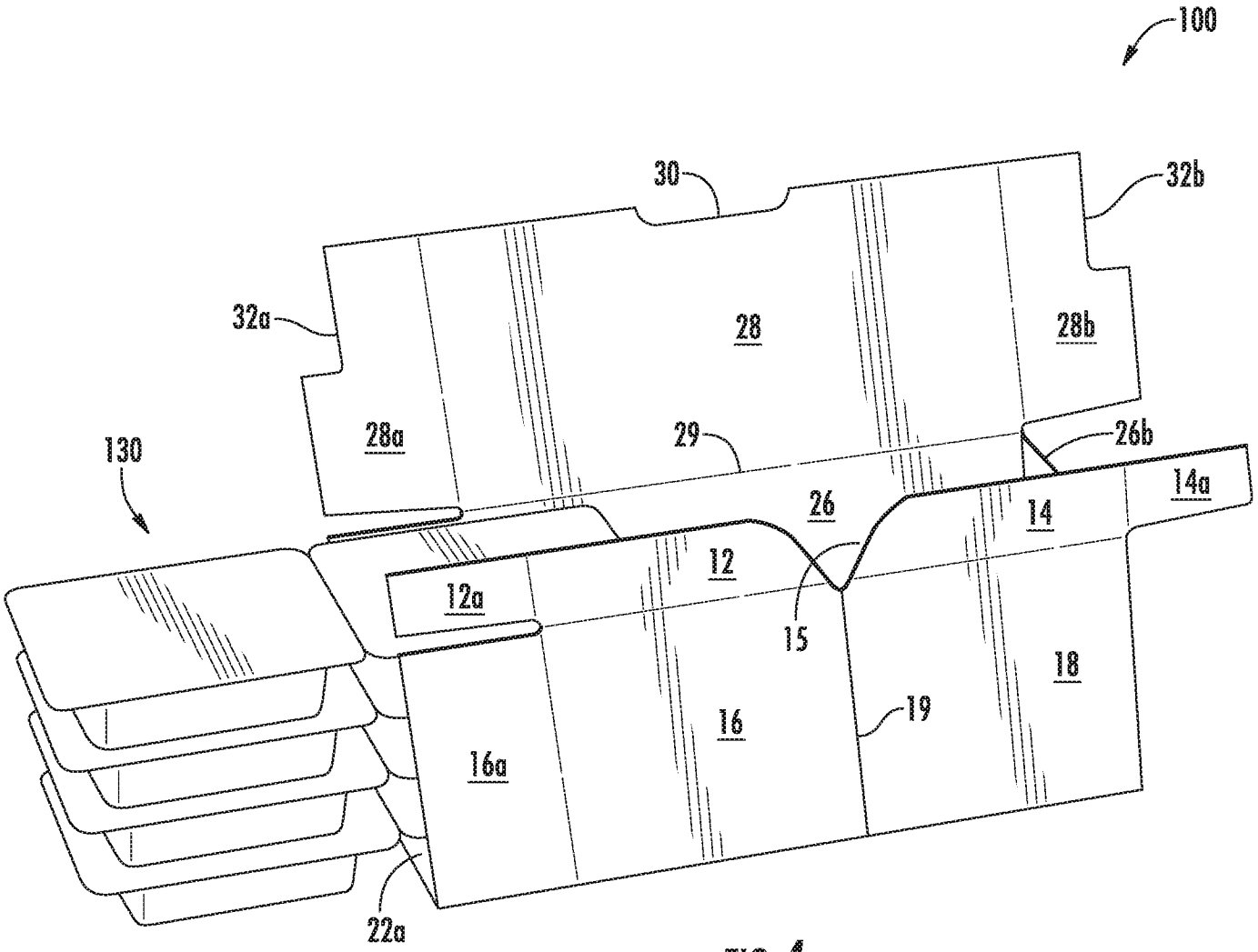
FIG. 4 is a perspective view of the retail ready package of the subject in a partially formed product loading condition.

Referring now to FIGS. 3 and 4, to erect the retail ready package 100 of the subject invention from the die cut blank 10, the left and right bottom panels 16 and 18 are folded relative to the left and right lower rear panels 22 and 24 along the lower front horizontal fold line 17, and the top panel 26 is folded relative to the upper rear panel 20 along the upper rear horizontal fold line 27. At such a time, two rows of products can be loaded into the partially erected package 100 in side-by-side relationship, as best seen in FIG. 4.

Thereafter, to fully erect the retail ready package 100 for shipping, the upper front panel 28 is folded relative to the top panel 26 along the upper front horizontal fold line 29, and left and right lower front panels 12 and 14 are folded relative to the left and right bottom panels 16 and 18 along the lower front horizontal fold line 17. Then, the side flaps of each of the panels are folded into place and glued, so as to fully form the package 100, as shown in FIG. 5. Adjacent contacting/facing surfaces of side flaps 28*a* and 16*a*, e.g. a portion of an inner surface of 28*a* that faces a portion of an outer surface of 16*a*, are free from glue to facilitate removal of the removable portion 110 from the display portion 120. Adjacent contacting/facing surfaces of side flaps 28*b* and 18*a*, e.g. a portion of an inner surface of 28*b* that faces a portion of an outer surface of 18*a*, are free from glue to facilitate removal of the removable portion 110 from the display portion 120. More particularly, side flaps 16*a*, 18*b*, 26*a* and 26*b* form interior side flaps of the package, while side flaps 12*a*, 14*a*, 20*a*, 20*b*, 22*a*, 24*a*, 28*a* and 28*b* form exterior side flaps of the package 100.

To prepare the retail ready package 100 of the subject invention for display, whereby the removable portion 110 of the package 100 can be separated from the display portion 120 of the package 100, the package 100 should be in its shipping orientation with products 130 facing upward as shown in FIG. 5. Then, as shown in FIG. 6, the upper rear panel 20, the top panel 26 and the upper front panel 28 are separated from the left and right lower front panels 12 and 14, the left and right bottom panels 16 and 18, and the left and right lower rear panels 22 and 24 along the shaped upper rear cut line 25 and the left and right cut line continuations 25*a* and 25*b*.

Thereafter, the display portion 120 of the retail ready package 100 with the products 130 therein, is repositioned into a display orientation shown in FIG. 7, wherein the left and right lower front panels 12 and 14 are facing forward, with the package seated on the left and right bottom panels 16 and 18. At such a time, the left lower front panel 12, the left bottom panel 16 and the left lower rear panel 22 are divided from the right lower front panel 14, the right bottom panel 18 and the right lower rear panel 24 along the bottom vertical perforation line 19 and the lower rear vertical perforation line 23 to form two separate product display cases 120*a* and 120*b*, as shown in FIG. 8. Thereupon, as shown in FIG. 9, the two separate product display cases 120*a* and 120*b* are retail ready with two rows of products 130*a* and 130*b* arranged side-by-side in a vertical front facing display orientation.

While the subject disclosure has been shown and described with reference to preferred embodiments, those skilled in the art will readily appreciate that changes or modifications may be made thereto without departing from the spirit or scope of the subject disclosure.

What is claimed is:

1. A blank for constructing a retail ready package configured for division into two separate product display cases, comprising:

a) left and right lower front panels;

b) left and right bottom panels respectively foldably connected to the left and right lower front panels along a lower front horizontal fold line and separated from one another along a bottom vertical perforation line;

c) left and right lower rear panels respectively foldably connected to the left and right bottom panels along a lower rear horizontal fold line and separated from one another along a lower rear vertical perforation line, wherein the left and right lower rear panels have respective left and right lower rear side flaps foldably connected thereto;

d) an upper rear panel separably connected to the left and right lower rear panels along a shaped upper rear cut line, wherein the upper rear panel has left and right upper rear side flaps foldably connected thereto, wherein the left and right upper rear side flaps are separated from the left and right lower rear side flaps by respective continuations of the shaped upper rear cut line associated with the upper rear panel, wherein the left and right lower rear panels and the upper rear panel form a combined panel and the upper rear side flaps are on opposite sides of the combined panel, wherein the shaped upper rear cut line and both of the respective continuations of the shaped upper rear cut line together form a shaped line of weakness having a first cut section, two second cut sections, two first perforated sections, wherein each of the first perforated sections is between the first cut section and a respective one of the second cut sections, two second perforated sections and two third cut sections, wherein each of the second perforated sections extends between a respective one of the second cut sections and a respective one of the third cut sections on a respective one of the upper rear side flaps, wherein a first of the third cut sections terminates at an edge of the left upper rear side flap and a second of the third cut section terminates at an edge of the right upper rear side flap, wherein each edge is between the elevation of top and bottom fold lines of the combined panel;

e) a top panel foldably connected to the upper rear panel along an upper rear horizontal fold line that is the top fold line of the combined panel;

f) an upper front panel foldably connected to the top panel along an upper front horizontal fold line.

2. The blank as recited in claim 1, wherein the upper rear panel, the top panel and the upper front panel are adapted and configured to be separated from the left and right lower front panels, the left and right bottom panels and the left and right lower rear panels along the shaped upper rear cut line associated with the upper rear panel.

3. The blank as recited in claim 2, wherein the left lower front panel, the left bottom panel and the left lower rear panel are adapted and configured to be divided from the right lower front panel, the right bottom panel and the right lower rear panel along the bottom vertical perforation line and the lower rear vertical perforation line to form two separate product display cases.

4. The blank as recited in claim 1, wherein the first cut section includes a first linear cut segment having a length of ¾ of an inch, and a second linear cut segment having a length of one inch, wherein the second linear cut segment is at an angle relative to the first linear cut segment.

5. The blank as recited in claim 1, wherein each of the first perforated sections extends linearly from the first cut section and has a length of 3 inches.

6. The blank as recited in claim 1, wherein at least one of the second cut sections includes a first linear cut segment having a length of 2.75 inches, a second linear cut segment extending from the first linear cut segment having a length of one inch, an arcuate cut segment tangentially extending from the second linear cut segment, and a third linear cut segment extending from the arcuate cut segment having a length of 15/16 of an inch, wherein the second linear cut segment is angled relative to the first linear cut segment, wherein the arcuate cut segment has a radius of 0.709 inches, wherein the arcuate cut segment extends between and is tangential to the second and third linear cut segments, and wherein the third linear cut segment is angled relative to the second linear cut segment.

7. The blank as recited in claim 6, wherein the second linear cut segment of at least one of the second cut sections extends across a fold line between the upper rear panel and the upper rear side flap.

8. The blank as recited in claim 1, wherein at least one of the second perforated sections extends linearly from a respective one of the second cut sections, and wherein the at least one second perforated section has a length of 3 and 5/16 inches.

9. The blank as recited in claim 8, wherein at least one of the third cut sections includes a first linear cut segment having a length of 1 and 21/32 inches, an arcuate cut segment tangentially extending from the first linear cut segment, and a second linear cut segment having a length of 5/16 of an inch, wherein the second linear cut segment is angled relative to the first linear cut segment, wherein the arcuate cut segment has a radius of 0.709 inches, and wherein the arcuate cut segment extends between and is tangential to the first and second linear cut segments.

10. The blank as recited in claim 1, wherein the upper front panel has left and right upper front side flaps foldably connected thereto, wherein the bottom panel has left and right bottom side flaps foldably connected thereto, wherein a portion of a surface of the left upper front side flap and a portion of a surface of the left bottom side flap that face one another are free from glue to facilitate removal of the removable portion from the display portion, and wherein a portion of a surface of the right upper front side flap and a portion of a surface of the right bottom side flap that face one another are free from glue to facilitate removal of the removable portion from the display portion.

11. The blank as recited in claim 1, wherein the first cut section includes a first linear cut segment having a length of ¾ of an inch, wherein the first linear cut segment is bisected by lower rear vertical perforation line.

12. The blank as recited in claim 1, wherein the left and right lower front panels are separated from one another by a shaped front notch.

13. A retail ready package configured for division into two separate product display cases, comprising:

a) left and right lower front panels;

b) left and right bottom panels respectively foldably connected to the left and right lower front panels along a lower front horizontal fold line and separated from one another along a bottom vertical perforation line;

c) left and right lower rear panels respectively foldably connected to the left and right bottom panels along a lower rear horizontal fold line and separated from one another along a lower rear vertical perforation line, wherein the left and right lower rear panels have respective left and right lower rear side flaps foldably connected thereto;

d) an upper rear panel separably connected to the left and right lower rear panels along a shaped upper rear cut line, wherein the upper rear panel has left and right upper rear side flaps foldably connected thereto, wherein the left and right upper rear side flaps are separated from the left and right lower rear side flaps by respective continuations of the shaped upper rear cut line associated with the upper rear panel, wherein the left and right lower rear panels and the upper rear panel form a combined panel and the upper rear side flaps are on opposite sides of the combined panel, wherein the shaped upper rear cut line and both of the respective continuations of the shaped upper rear cut line together form a shaped line of weakness having a first cut section, two second cut sections, two first perforated sections, wherein each of the first perforated sections is between the first cut section and a respective one of the second cut sections, two second perforated sections and two third cut sections, wherein each of the second perforated sections extends between a respective one of the second cut sections and a respective one of the third cut sections on a respective one of the upper rear side flaps, wherein a first of the third cut sections terminates at an edge of the left upper rear side flap and a second of the third cut section terminates at an edge of the right upper rear side flap, wherein each edge is between the elevation of the top and bottom fold lines of the combined panel;

e) a top panel foldably connected to the upper rear panel along an upper rear horizontal fold line that is the top fold line of the combined panel; and f) an upper front panel foldably connected to the top panel along an upper front horizontal fold line.

14. The retail ready package as recited in claim 13, wherein the upper rear panel, the top panel and the upper front panel are adapted and configured to be separated from the left and right lower front panels, the left and right bottom panels and the left and right lower rear panels along the shaped upper rear cut line associated with the upper rear panel.

15. The retail ready package as recited in claim 14, wherein the left lower front panel, the left bottom panel and the left lower rear panel are adapted and configured to be divided from the right lower front panel, the right bottom panel and the right lower rear panel along the bottom vertical perforation line and the lower rear vertical perforation line to form two separate product display cases.

16. The retail ready package as recited in claim 15, wherein two rows of products are arranged side-by-side within the package in a vertical front facing display orientation relative to the left and right lower front panels of the package.

17. The retail ready package as recited in claim 13, wherein the upper front panel has left and right upper front side flaps foldably connected thereto, wherein the bottom panel has left and right bottom side flaps foldably connected thereto, wherein a portion of a surface of the left upper front side flap and a portion of a surface of the left bottom side flap that face one another are free from glue to facilitate removal of the removable portion from the display portion, and wherein a portion of a surface of the right upper front side flap and a portion of a surface of the right bottom side flap that face one another are free from glue to facilitate removal of the removable portion from the display portion.

18. The retail ready package as recited in claim 13, wherein the left and right lower front panels are separated from one another by a shaped front notch.

19. The blank as recited in claim 1, wherein the shaped line of weakness is symmetrical about the lower rear vertical perforation line.

20. The blank as recited in claim 13, wherein the shaped line of weakness is symmetrical about the lower rear vertical perforation line.

* * * * *